US008413735B2

(12) United States Patent
Tsuji et al.

(10) Patent No.: US 8,413,735 B2
(45) **Date of Patent: *Apr. 9, 2013**

(54) FIRE PREVENTION EQUIPMENT AND SPRAYING METHOD

(75) Inventors: Toshihide Tsuji, Tokyo (JP); Tatsuya Hayashi, Tokyo (JP)

(73) Assignee: Hochiki Corporation, Tokyo (JP)

( * ) Notice: Subject to any disclaimer, the term of this patent is extended or adjusted under 35 U.S.C. 154(b) by 77 days.

This patent is subject to a terminal disclaimer.

(21) Appl. No.: 13/086,582

(22) Filed: Apr. 14, 2011

(65) Prior Publication Data

US 2011/0186311 A1 Aug. 4, 2011

Related U.S. Application Data

(63) Continuation of application No. PCT/JP2009/050653, filed on Jan. 19, 2009.

(51) Int. Cl.
*A62C 35/00* (2006.01)

(52) U.S. Cl. ..... 169/45; 169/5; 169/37; 169/46; 169/54; 239/690; 239/690.1; 239/696; 239/708

(58) Field of Classification Search ..... 169/5, 16, 169/37, 45, 46, 47, 54; 239/690, 690.1, 691, 239/696, 708

See application file for complete search history.

(56) References Cited

U.S. PATENT DOCUMENTS

| | | | | |
|---|---|---|---|---|
| 5,353,879 | A * | 10/1994 | Watanabe et al. | 169/54 |
| 5,794,704 | A * | 8/1998 | Brennecke et al. | 169/54 |
| 2012/0000677 | A1 * | 1/2012 | Tsuji et al. | 169/5 |

FOREIGN PATENT DOCUMENTS

| | | |
|---|---|---|
| JP | 58-174258 | 10/1983 |
| JP | 03-186276 | 8/1991 |
| JP | 3-186277 | 8/1991 |
| JP | 10-118214 | 5/1998 |
| JP | 11-192320 | 7/1999 |
| JP | 2005-287655 | 10/2005 |

OTHER PUBLICATIONS

International Search Report issued Mar. 31, 2009 in International (PCT) Application No. PCT/JP2009/050653.

* cited by examiner

*Primary Examiner* — Steven J Ganey
(74) *Attorney, Agent, or Firm* — Wenderoth, Lind & Ponack, L.L.P.

(57) ABSTRACT

Fire-extinguishing agent supplying equipment pressurizes a water-based fire-extinguishing agent and supplies the agent via a pipe; and the water-based fire-extinguishing agent is pressurized and supplied via the pipe to an electrification spray head installed in a protection area A, and the jetted particles of the fire-extinguishing agent are electrified and sprayed from the electrification spray head. A pulsed or alternating electrification voltage is applied to the electrification spray head from a voltage application unit 15, and an external electric field generated by applying the voltage between a water-side electrode unit and an induction electrode unit is applied to the fire-extinguishing agent in a jetting process to electrify the jetted particles.

12 Claims, 10 Drawing Sheets

FIRE PREVENTION EQUIPMENT AND SPRAYING METHOD

This application is a continuation of PCT/JP2009/050653 filed Jan. 19, 2009.

BACKGROUND OF THE INVENTION

1. Field of the Invention

The present invention relates to fire prevention equipment and a spraying method for spraying a water-based fire-extinguishing agent containing water, seawater, and/or a fire-extinguishing chemical agent from a head.

2. Description of the Related Arts

Conventionally, the water-based fire prevention equipment of this type includes sprinkler fire extinguishment, water atomization fire-extinguishing equipment, water mist fire-extinguishing equipment, and so on. Particularly, the water mist fire-extinguishing equipment downsizes water particles to 20 to 200 μm or fraction of that of the sprinkler equipment or water atomization equipment and discharges the water particles to space, thereby expecting a fire extinguishing effect with a small water volume by a cooling effect and the oxygen supply inhibiting effect of evaporated water.

Recently, the sprinkler fire-extinguishing equipment, water atomization fire-extinguishing equipment, or water mist fire-extinguishing equipment using water as a fire extinguishing agent is re-evaluated since the equipment uses water friendly to environments and human bodies as the fire extinguishing agent compared with gas-based fire-extinguishing agents of, for example, carbon dioxide and nitrogen.

Patent Document 1: Japanese Patent Application Laid-Open Publication No. H11-192320

Patent Document 2: Japanese Patent Application Laid-Open Publication No. H10-118214

However, although the high fire extinguishing ability of the conventional sprinkler fire extinguishing equipment and a water atomization fire-extinguishing equipment is generally known, the discharged water volume thereof is large in order to ensure the fire extinguishing ability, and reducing the wet damage caused upon fire extinguishment or after fire extinguishment is a problem. On the other hand, the water mist fire-extinguishing equipment, which is assumed to cause small wet damage, is intended to obtain a cooling effect and the effect of inhibiting oxygen supply by evaporated water by filling space with comparatively small water particles; however, the fire extinguishing effect thereof is not so high in reality. A conceivable cause therefor is that the small water particles are repelled by the molecular movement of the high-temperature air that is in contact with high-temperature burning objects, wherein the effect of adhering to and wetting the burning surfaces thereof is small.

SUMMARY OF THE INVENTION

It is an object of the present invention to provide the fire prevention equipment and a spraying method capable of extinguishing and suppressing fire efficiently with a small spray volume of a water-based fire-extinguishing agent.

(Fire Prevention Equipment)

The present invention provides a fire prevention equipment provided with:

a fire-extinguishing agent supplying equipment for pressurizing and supplying a water-based fire-extinguishing agent via a pipe;

an electrification spray head for electrifying jetted particles of the fire-extinguishing agent pressurized and supplied by the fire-extinguishing agent supplying equipment and spraying the particles, the head being installed in a protection section; and a voltage application unit for applying an electrification voltage to the electrification spray head.

Herein, the electrification spray head is provided with an injection nozzle for converting the water-based fire-extinguishing agent to particles and spraying the particles by jetting the fire-extinguishing agent to external space, an induction electrode unit disposed in a jetting space side of the injection nozzle, and a water-side electrode unit disposed in the injection nozzle and brought into contact with the water-based fire-extinguishing agent; and the voltage application unit charges the jetted particles by applying an external electric field generated by applying a voltage between the induction electrode unit and the water-side electrode unit of the electrification spray head to the water-based fire-extinguishing agent in a jetting process from the injection nozzle.

The water-side electrode unit of the electrification spray head is part of the injection nozzle using an electrically conductive material or a pipe using an electrically conductive material.

The induction electrode unit of the electrification spray head is any of or a complex of a metal having electric conductivity, a resin having electric conductivity and a rubber having electric conductivity, and has any of a ring shape, a cylindrical shape, a vertical flat-plate shape, a parallel-plate shape, a linear shape and a wire-mesh shape.

The electrification spray head in which the voltage of the water-side electrode unit is to be zero volt, the water-side electrode unit is led to earth, and the induction electrode unit is applied a predetermined electrification voltage from the voltage application unit.

The voltage application unit applies the predetermined DC, AC, or pulsed electrification voltage to the induction electrode unit. The voltage application unit applies the predetermined electrification voltage of less than ±20 kilovolts to the induction electrode unit.

Part or all of the induction electrode is coated with an insulating material.

The water-based fire-extinguishing agent is water, seawater, or water containing fire-extinguishing power enhancing chemical agent.

(Spraying Method)

The present invention provides a spraying method of the fire prevention equipment, including, in case of fire, pressurizing a water-based fire-extinguishing agent and supplying the fire-extinguishing agent to an electrification spray head via a pipe, the electrification spray head being installed in a protection section; and, when jetted particles of the pressurized and supplied fire-extinguishing agent are to be sprayed from the electrification spray head, electrifying and spraying the jetted particles.

According to the present invention, when the water particles sprayed from the electrification spray head are electrified, adhesion of the water particles to all the surfaces of burning materials occurs not to mention the adhesion of the water particles to high-temperature burning surfaces because of the Coulomb force, wherein the wetting effect is significantly increased, and fire-extinguishing power can be enhanced compared with normal non-electrified water particles.

Moreover, for example when electrified spray is carried out only with negative electric charge, repulsive force works between the water particles in the air, the probability that the particles are collided and associated with each other and grow and fall is low, the density of the water particles staying in the air is high, which is also a reason of high fire extinguishing power.

When the inventors of the present application carried out fire extinguishing experiments, innovative improvement in fire extinguishing performance more than original expectation was confirmed compared with conventional non-electrified spray. According to the electrified spray of the present invention, an equivalent fire extinguishing effect is obtained by the fire-extinguishing water volume that is about one quarter of that of conventional non-electrified spray.

Moreover, according to the electrified spray of the present invention, it was experimentally confirmed that the smoke removing performance of the smoke generated upon fire was significantly improved compared with conventional non-electrified spray, and this is an innovative result not expected at first. According to the electrified spray of the present invention, an equivalent smoke removing effect is obtained by the fire extinguishing water volume that is about one fifth of that of conventional non-electrified spray.

BRIEF DESCRIPTION OF THE INVENTION

THE PREFERRED EMBODIMENT

Figure 1:
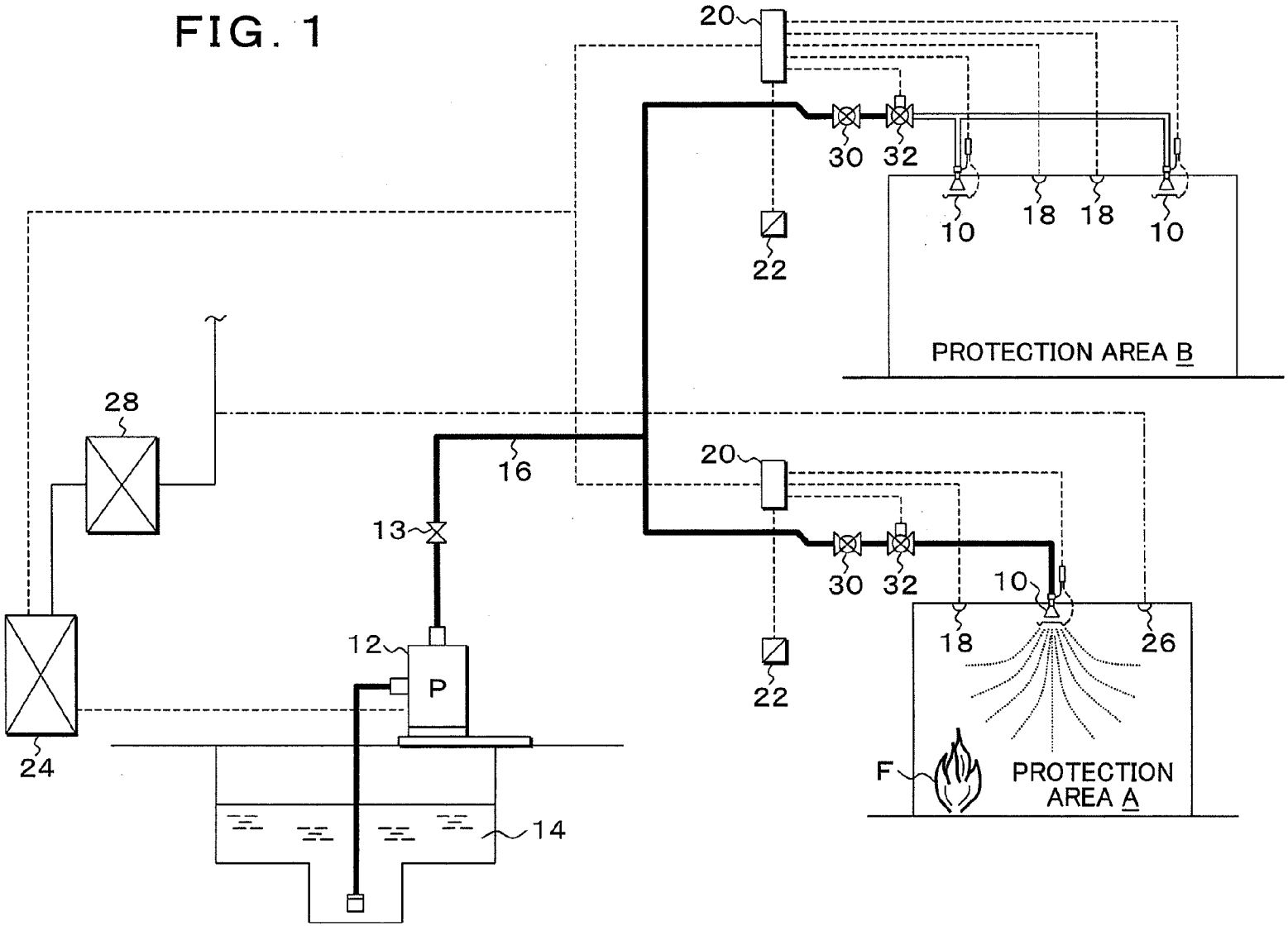
FIG. 1 is an explanatory drawing showing an embodiment of a fire prevention equipment according to the present invention.

FIG. 1 is an explanatory drawing showing an embodiment of a fire prevention equipment according to the present invention. In FIG. 1, electrification spray heads 10 according to the present embodiment are installed on the ceiling side of protection areas A and B such as computer rooms in a building. A pipe 16 is connected to the electrification spray heads 10 via a manual valve (gate valve) 13 from the projecting side of a pump unit 12 installed for a water source 14, which functions as fire extinguishing agent supplying equipment. The pipe 16 is branched and then connected to the electrification spray heads 10, which are installed in the protection areas A and B, respectively, via pressure regulating valves 30 and automatic open/close valves 32. A dedicated fire detector 18, which controls the spraying from the electrification spray heads 10, is installed in each of the protection areas A and B. A linked control relaying device 20 is provided for each of the protection areas A and B, and a manual operation box 22 for controlling the spraying from the electrification spray heads 10 by manual operations is further provided for each of them. Signal lines from the dedicated fire detector 18 and the manual operation box 22 are connected to the linked control relaying device 20, and a signal line for applying the voltage for electrification drive to the electrification spray head 10 and a signal line for subjecting the automatic open/close valve 32 to open/close control are wired thereto.

Furthermore, a fire detector 26 of automatic fire alarm equipment is installed in the protection area A and is connected to a detector line from a receiver 28 of the automatic fire alarm equipment.

The fire detector 26 of the automatic fire alarm equipment is not provided for the protection area B; however, it goes without saying that the detector may be provided in accordance with needs. The linked control relaying devices 20 installed corresponding to the protection areas A and B, respectively, are connected to a system monitoring control board 24 by signal lines. The receiver 28 of the automatic fire alarm equipment is also connected to the system monitoring control board 24. Furthermore, the system monitoring control board 24 is connected to the pump unit 12 by a signal line and controls pump start/stop of the pump unit 12.

Figure 2:
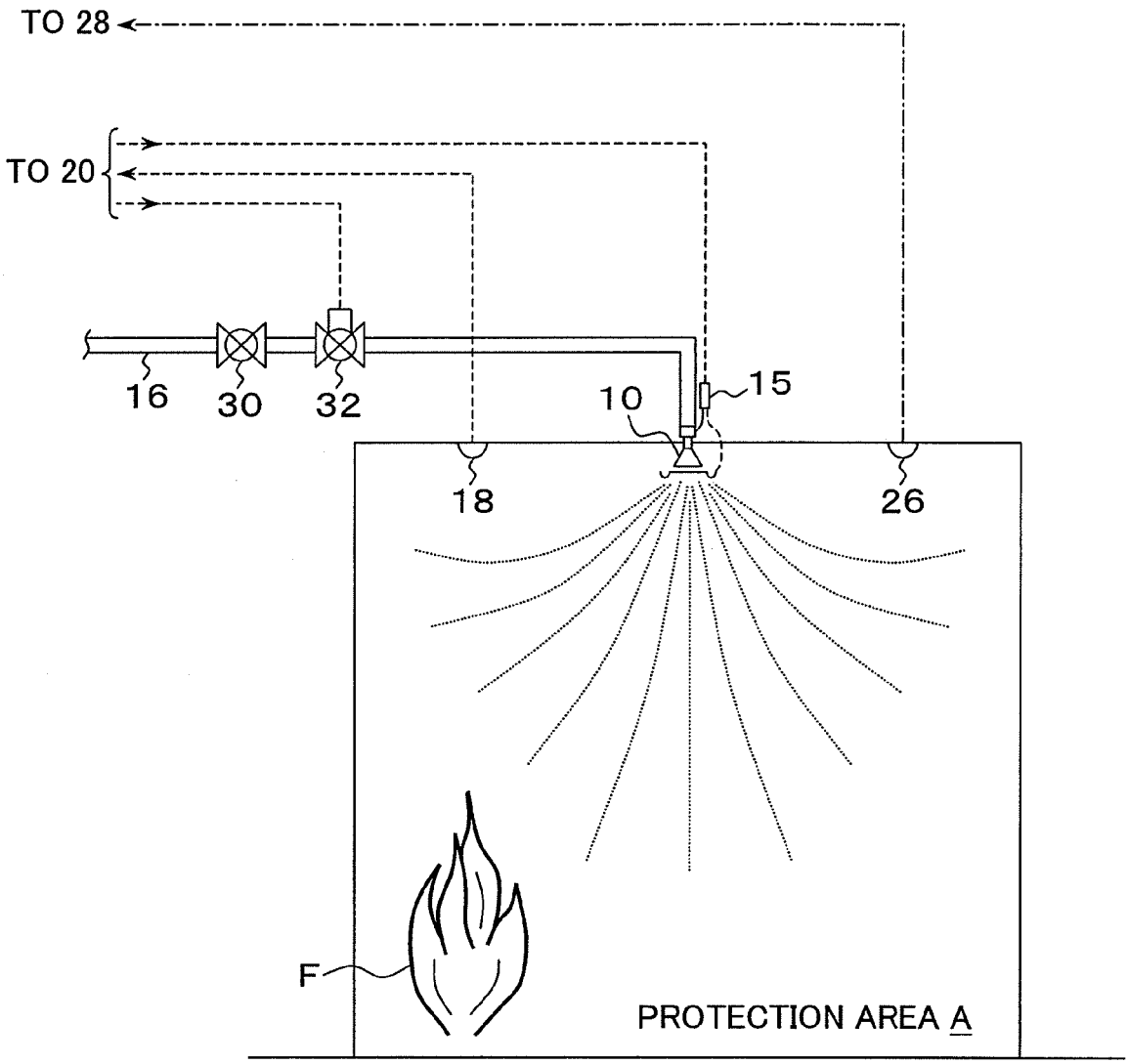
FIG. 2 is an explanatory drawing focusing on a protection area A of FIG. 1.

FIG. 2 is an explanatory drawing focusing on the protection area A of FIG. 1. The electrification spray head 10 is installed in the ceiling side of the protection area A. The pipe 16 from the pump unit 12 shown in FIG. 1 is connected to the electrification spray head 10 via the pressure regulating valve 30 and the automatic open/close valve 32. A voltage application unit 15 is installed at an upper part of the electrification spray head 10 so as to apply a predetermined voltage to the electrification spray head 10 as is elucidated in later explanation so that the fire extinguishing agent jetted from the electrification spray head 10 can be electrified and sprayed. Moreover, the dedicated fire detector 18 is installed in the ceiling side of the protection area A, and the fire detector 26 of the automatic fire alarm equipment is also connected thereat.

Figure 3A:
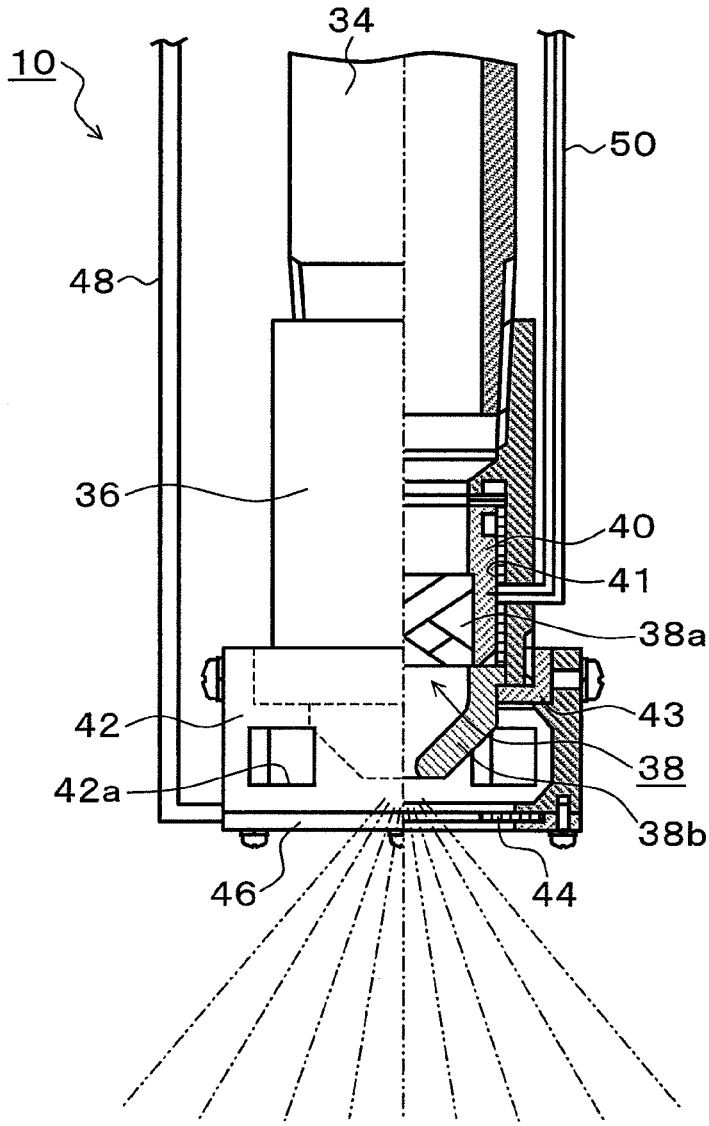
FIGS. 3A and 3B are explanatory drawings showing an embodiment of an electrification spray head using a ring induction electrode unit.
Figure 3B:
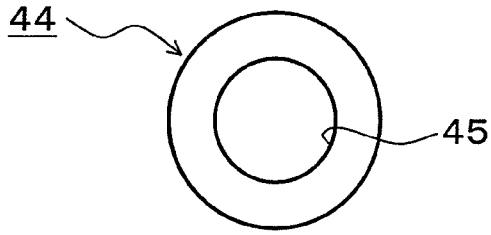

FIGS. 3A and 3B show embodiments of the electrification spray head 10 shown in FIG. 1 and FIG. 2, and this embodiment is characterized by using a ring induction electrode unit. In FIG. 3A, in the electrification spray head 10, a head main body 36 is screw-fixed with a distal end of a falling pipe 34 connected to the pipe from the pump unit 12. A cylindrical water-side electrode unit 40 is incorporated at the inside of the distal end of the head main body 36 via an insulating member 41. An earth cable 50 is wired from the voltage application unit 15, which is installed at the upper part as shown in FIG. 2, with respect to the water-side electrode unit 40 and is connected to the water-side electrode unit 40, which is installed at the inside of the head main body 36 via the insulating member 41. The application voltage of the water-side electrode unit 40 is caused to be 0 volt and led to the earth side by the connection of the earth cable 50. An injection nozzle 38 is provided below the water-side electrode unit 40. The injection nozzle 38 is composed of a nozzle rotor 38*a*, which is provided in the interior of the water-side electrode unit 40 side, and a nozzle head 38*b*, which is provided in the distal end side. The injection nozzle 38 receives supply of the water-based fire-extinguishing agent, which is pressurized and supplied from the pump unit 12 of FIG. 1, from the falling pipe 34; and the injection nozzle converts the water-based fire-extinguishing agent into particles and sprays the particles when the water-based fire-extinguishing agent passes through the nozzle main body 38*a* and is jetted from the nozzle head 38*b* to the outside. In the present embodiment, the spray pattern sprayed from the injection nozzle 38 has the shape of a so-called full cone. A cover 42 using an insulating material is fixed by screw-fixing with respect to the injection nozzle 38 via a fixing member 43. The cover 42 is an approximately-cylindrical member and incorporates a ring-like induction electrode unit 44 in an open part in the lower side by screw-fixing of a stopper ring 46. As is focused on in FIG. 3B, the ring-like induction electrode unit 44 forms an opening 45, which allows the jetted particles from the injection nozzle 38 to pass therethrough, at the center of a ring-like main body thereof. With respect to the ring-like induction electrode unit 44 disposed below the cover 42, an electrode application cable 48 is wired from the voltage application unit 15 in the upper part shown in FIG. 2; and the electrode application cable 48 penetrates through the cover 42, which is composed of the insulating material, and is connected to the ring-like induction electrode unit 44 so that a voltage can be applied thereto. Herein, the water-side electrode unit 40 and the ring-like induction electrode unit 44 used in the electrification spray head 10 of the present embodiment of the present embodiment may be, other than metal having electrical conductivity, a resin having electrical conductivity, rubber having electrical conductivity, or a combination of these.

When the water-based fire-extinguishing chemical agent is to be sprayed from the electrification spray head 10, the voltage application unit 15 shown in FIG. 2 is operated by a control signal, which is from the linked control relaying device 20 shown in FIG. 1, and applies a DC, AC, or pulsed application voltage of, for example, less than 20 kilovolts to the ring-like induction electrode unit 44 while the water-side electrode unit 40 serves as the earth side of 0 volt. When a voltage of, for example, several kilovolts is applied between the water-side electrode unit 40 and the ring-like induction electrode unit 44 in this manner, an external electric field is generated between the electrodes by this voltage application, the jetted particles are electrified through the jetting process of converting the water-based fire-extinguishing agent to the jetted particles from the injection nozzle 38, and the electrified jetted particles can be sprayed to the outside. Next, a monitoring operation in the embodiment of FIG. 1 will be explained. If fire F occurs in the protection area A at this point, for example, the dedicated fire detector 18 detects the fire and transmits a fire detection signal to the system monitoring control board 24 via the linked control relaying device 20. When the system monitoring control board 24 receives the emission of the alarm of the dedicated fire detector 18 installed in the protection area A, the system monitoring control board 24 activates the pump unit 12, pumps up the fire extinguishing water from the water source 14, pressurizes the water by the pump unit 12, and supplies the water to the pipe 16. At the same time, the system monitoring control board 24 outputs an activation signal of the electrification spray head 10 to the linked control relaying device 20, which is provided corresponding to the protection area A. In response to this activation signal, the linked control relaying device 20 carries out an operation of opening the automatic open/close valve 32, thereby supplying the water-based fire-extinguishing agent of a constant pressure regulated by the pressure regulating valve 30 to the electrification spray head 10 via the opened automatic open/close valve 32 and spraying the fire-extinguishing agent as jetted particles from the electrification spray head 10 to the protection area A as focused in FIG. 2. At the same time, the linked control relaying device 20 transmits an activation signal to the voltage application unit 15 provided at the electrification spray head 10 shown in FIG. 2; and, in response to the activation signal, the voltage application unit 15 supplies a DC, AC, or pulsed application voltage of, for example, several kilovolts to the electrification spray head 10. Therefore, in the electrification spray head 10 shown in FIG. 3A, when the pressurized water-based fire-extinguishing agent is to be converted to jetted particles by jetting and sprayed from the injection nozzle 38, a voltage of several kilovolts is applied to the ring-like induction electrode unit 44 side connected to the voltage application cable 48 while the water-side electrode unit 40 connected to the earth cable 50 is at 0 volt. The external electric field generated by this voltage application can be applied to the water-based fire-extinguishing agent which is in the jetting process in which the agent is jetted from the injection nozzle 38 and passes through the opening 45 of the ring-like induction electrode unit 44 so as to electrify and spray the jetted particles converted by the jetting.

As is focused on in FIG. 2, the water particles jetted from the electrification spray head 10 toward the protection area A in which the fire F is occurring are electrified. Therefore, the water particles efficiently adhere to high-temperature burning sources of the fire F because of the Coulomb force caused by the electrification, and adhesion to all the surfaces of burning materials occur at the same time; wherein, compared with the case in which conventional non-electrified water particles are sprayed, the wetting effect with respect to the burning materials is significantly increased, and a high fire extinguishing ability is exerted. Furthermore, for example when a positive voltage is applied to the ring-like induction electrode unit 44 in a pulsed manner while the water-side electrode unit 40 is at 0 volt in the electrification spray head 10 of FIG. 3A, the sprayed water particles are electrified only with negative electric charge in the spraying. When the water particles electrified only with the negative electric charge in this manner are sprayed, repulsive force works between the electrified water particles in the air, thereby reducing the probability that the water particles are collided and associated mutually and grown and fall, and the density of the water particles staying in the air is increased. As a result, a high fire-extinguishing ability is exerted. Furthermore, a smoke removing effect of efficiently removing the smoke generated by the fire F can be obtained by spraying the electrified water particles from the electrification spray head 10 to the protection area A. The smoke removing effect exerted by spraying conventional water particles is a capturing action by probabilistic collision between the water particles and smoke particles; on the other hand, the smoke removing effect of the present embodiment described above collects the smoke particles, which are similarly in an electrified state, by the water particles by the Coulomb force by electrifying the sprayed water particles in the present embodiment, thereby exerting a remarkable smoke removing action. Herein, regarding the particle sizes of the water particles sprayed from the electrification spray head 10 of the present embodiment, the particle sizes of the case in which, for example, the injection nozzle 38 of FIG. 3A is used include various particle sizes. The particle sizes of the water particles are not particularly defined in the present embodiment. However, in consideration of the advantage of the adhesion to burning substances by the Coulomb force, the injection nozzle 38 including many water particles of about 200 μm or less is desired to be used. Next, the fire extinguishing effect according to the present embodiment will be explained. As has already been explained, in the spraying of the electrified jetted particles using the electrification spray head 10 of the present embodiment, the water particles are electrified; as a result, adhesion to all the surfaces of burning materials occurs not to mention the adhesion to high burning surfaces because of the Coulomb force, and the wetting effect is significantly increased compared with conventional non-electrified water particles. Therefore, high fire extinguishing power is obtained. Furthermore, when the water particles are electrified, for example, only with negative electric charge and discharged, repulsive force works between the water particles in the air, the probability that the particles are mutually collided and associated and grow and fall is reduced, and the density of the water particles staying in the air becomes high, which is also a reason of the high fire extinguishing ability. Because of such reasons, in the electrified discharge of the water particles using the electrification spray head of the present embodiment, fire extinguishing performance is significantly improved compared with the conventional non-electrified water particle spraying. The inventors of the present application have carried out below fire extinguishing experiments for confirming improvement of the fire extinguishing performance.

Experiment Example 1

Fire Extinguishing Test Results of Wood Crib Fire
Experiment Conditions
Nozzle Jetting Amount: 8 liters/minute at 1 MPa
Induction Electrode Voltage: 2 kilovolts
Fire Model: 12-millimeter-square,
150-millimeter-square wood logs×22
Ignition Agent: n-Heptane Ignition
Fire Extinguishing Time
With Electrification: 14 seconds
Without Electrification: 54 seconds According to these experiment results, in the electrified spray according to the present embodiment, an equivalent fire extinguishing effect is obtained with a fire extinguishing water volume that is about 26 percent of the volume in the non-electrified spray, in other words, with about a quarter fire extinguishing water volume. Next, the smoke removing effect caused by the electrified spray in the present embodiment will be explained.

Figure 4A:
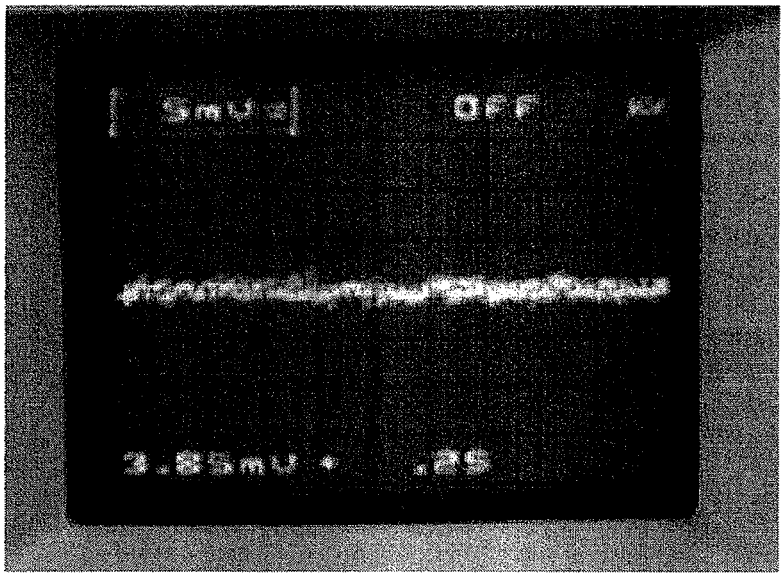
FIGS. 4A and 4B are explanatory drawings showing the experiment results for confirming that the smoke caused by fire is electrically charged.

The electrified spray of the present embodiment significantly improves the smoke removing performance of the smoke generated upon fire compared with conventional non-electrified spray. The inventors of the present application confirmed by experiments that the smoke caused by fire was electrically charged. FIG. 4A is a photograph of a synchroscope showing the electric charge state of the smoke measured by a passing type Faraday gauge.

Figure 4B:
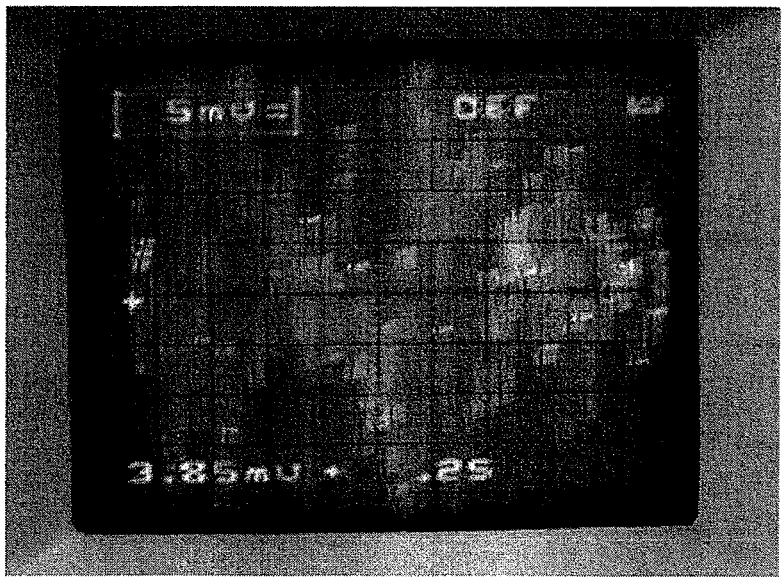

FIG. 4A shows the output of the passing type Faraday gauge in a smokeless state, wherein a noise level is approximately constant. FIG. 4B shows the output of the passing type Faraday gauge taken when smoke passes therethrough, wherein the waveform of the synchroscope largely goes up and down on the screen, which shows that the electrified state of the smoke particles is notable. The reason why the high smoke removing effect is obtained by the electrified spray according to the present embodiment is that the smoke removing effect is increased since the smoke particles in the electrified state are collected by the Coulomb force as is clear from the synchroscope waveform of FIG. 4B as a result of electrifying the water particles in the present embodiment, while the smoke capturing by the conventional non-electrified spray is a capturing means by probabilistic collision between the smoke particles and the water particles. For example, if the water particles in the electrified state are 100 to 200 μm, the smoke particles which are similarly in an electrified state are 1 to 2 μm, and the numerous small smoke particles present around the water particles are collected by the Coulomb force. As a result, a large smoke removing effect is obtained. In order to confirm the increase in the smoke removing effect according to the present embodiment, the below experiment was carried out.

Experiment Example 2

Figure 5:
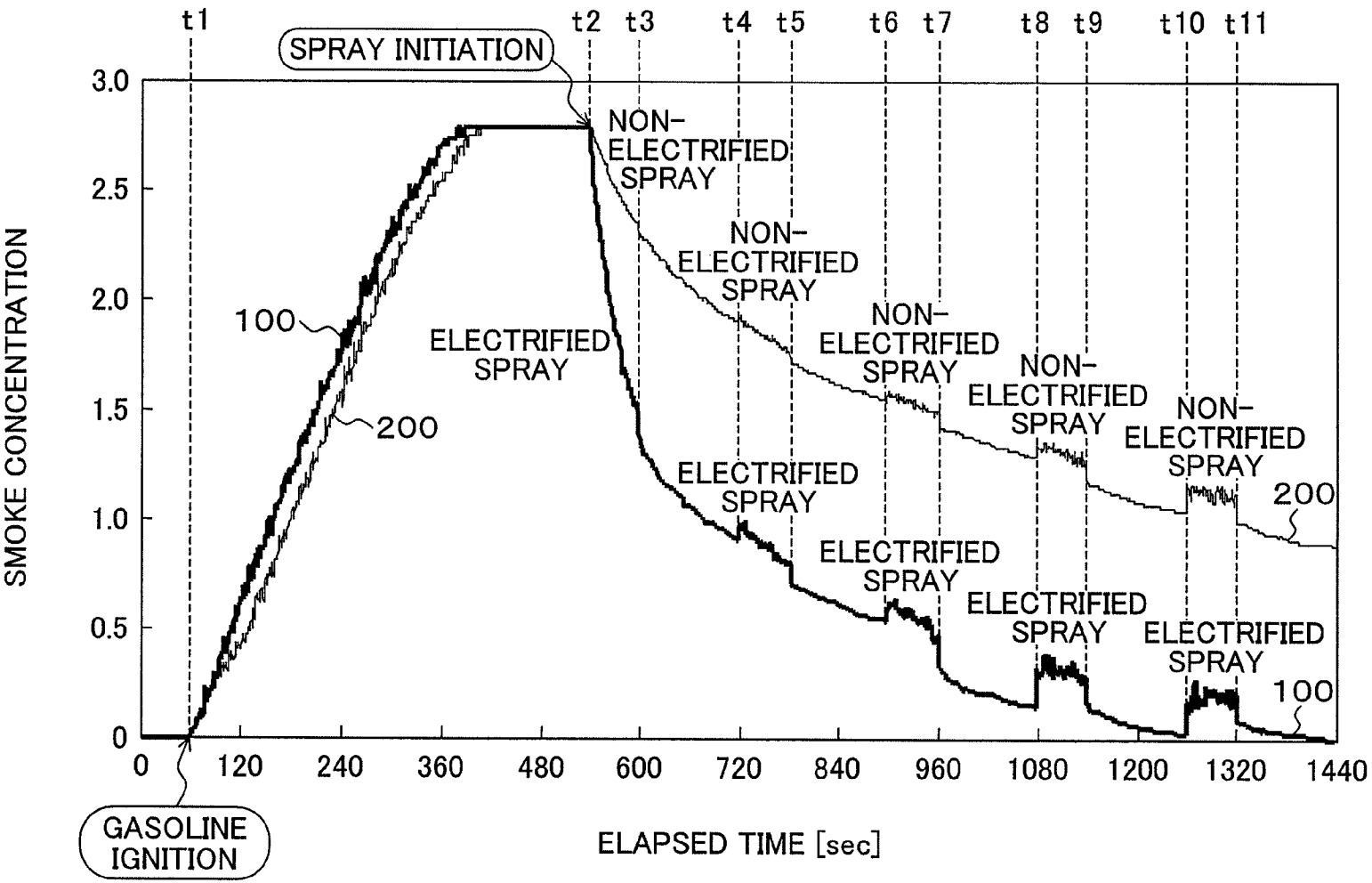
FIG. 5 is a graph chart showing the experiment results for confirming the smoke removing effect of the present embodiment.

Nozzle Jetting Amount: 8 liters/minute at 1 MPa
Induction Electrode Voltage: 2 kilovolts
Water Discharge Pattern: Pulsed application water discharge
Fire Model: After closed space of 1.8 cubic meter was filled with smoke by burning 50 milliliters of gasoline therein, five cycles of spraying were carried out with 60-second water discharge and 120-second interval, and transition of the concentration of the smoke was measured FIG. 5 is a graph chart showing the experiment results of Experiment Example 2. The experiment results of FIG. 5 shows the elapsed time by the horizontal axis and the smoke concentration by the vertical axis. An experiment characteristic 100 is the electrified spray according to the present embodiment, and an experiment characteristic 200 is conventional non-electrified spray. In FIG. 5, when gasoline is ignited at time t1, the smoke concentration is rapidly increased as shown by the experiment characteristics 100 and 200; and, when they are actually observed from outside, the closed space is completely black and in an completely invisible state due to the smoke of burning. Subsequently, spray is started at time t2. Regarding the experiment characteristic 100 of the present embodiment, first, first electrified spray is carried out from time t2 to t3, and the smoke concentration is rapidly reduced to 1.3 percent by this first electrified spray. The change in the smoke concentration from the time t2 to t3 is a rapid smoke removing action wherein the smoke is instantly removed from the state of the smoke in the closed space which has been completely black when visually observed, and the state in which the interior becomes somewhat visible is obtained; and this is carried out during the electrified spray of only 60 seconds. Subsequently, after the interval of 120 seconds is finished, second electrified spray is carried out at time t4 to t5.

Thereafter, electrified spray is repeated at t6 to t7, t8 to t9, and t10 to 11. As a result, along with the increased in the number of times of the electrified spray, the smoke concentration can be changed to approximately 0 percent by, for example, the fifth electrified spray, in other words, the smoke can be removed to a completely smokeless state.

On the other hand, in the conventional characteristic 200 which is non-electrified spray, non-electrified spray is carried out five times at time t2 to t3, time t4 to t5, time t6 to t7, time t8 to t9, and time t10 to t11 with 120-second intervals therebetween as well as the experiment characteristic of the present embodiment. However, reduction in the smoke concentration is slow, and the smoke concentration of the conventional non-electrified experiment characteristic 200 is approximately two times that of the experiment characteristic 100 of the present embodiment; and, according to this comparison of the experiment results, it was confirmed that a significant smoke removing effect was obtained in the present embodiment. Regarding the smoke removing effect according to the present embodiment elucidated from the experiment results shown in FIG. 5, the smoke removing effect was a notable result not expected at all, although the inventors of the present application had some expectations about the fire extinguishing effect at the point when the idea of introducing electrified spray to fire extinguishment first occurred to them. Note that, according to the experiment results of FIG. 5, according to the results of the time transition of the smoke concentration of the case of electrified spray and non-electrified spray under the same spray water volume condition, it was confirmed that the smoke removing effect equivalent to that of the conventional non-electrified spray was obtained by about one-fifth spray water volume by the electrified spray according to the present embodiment.

Figures 6A, 6B, 6C, 6D, 6E, 6F:
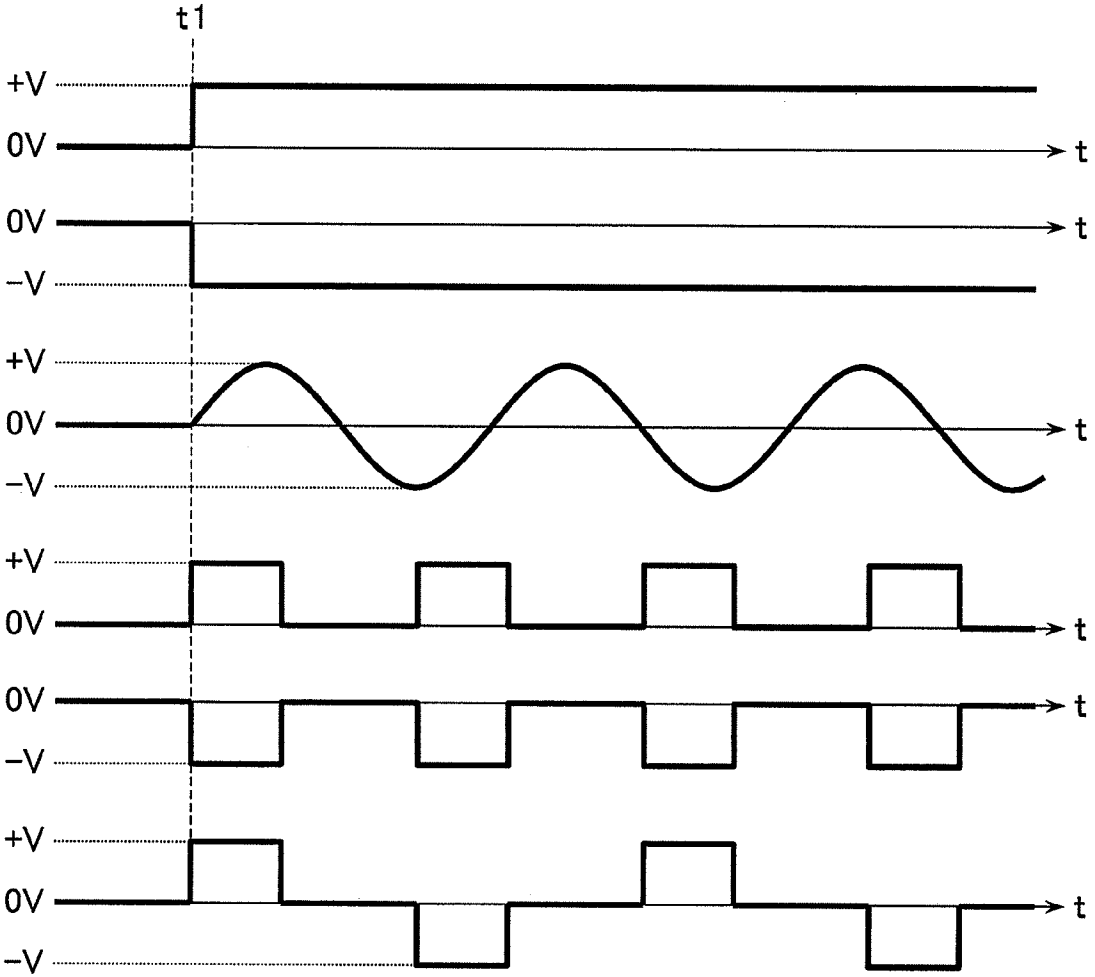
FIGS. 6A to 6F are time charts showing application voltages supplied to the electrification spray head of the present embodiment.

FIGS. 6A to 6F are time charts showing the application voltages applied from the voltage application unit 15 of the present embodiment to the electrification spray head 10. FIG. 6A shows the case in which a DC voltage of +V is applied, wherein negatively-electrified water particles are continuously sprayed in this case. FIG. 6B shows the case in which a DC voltage of −V is applied, wherein positively-electrified water particles are continuously sprayed in this case. FIG. 6C shows the case in which AC voltages of ±V are applied, wherein, in this case, negatively-electrified water particles are continuously sprayed in accordance with the changes in the AC voltage during positive half-cycle periods, and positively-electrified water particles are continuously sprayed in accordance with the changes in the AC voltage during negative half-cycle periods. FIG. 6D shows the case in which a pulsed voltage of +V is applied with predetermined intervals, wherein, in this case, negatively-electrified water particles are intermittently sprayed, and, in the periods in which no voltage is applied, non-electrified water particles are sprayed. FIG. 6E shows the case in which a pulsed voltage of −V is applied with predetermined intervals; wherein, in this case, positively-electrified water particles are intermittently sprayed, and, in the period in which no voltage is applied, on-electrified water particles are sprayed. FIG. 6F shows the case in which pulsed voltages of ±V are alternately applied with predetermined intervals therebetween, wherein, in this case, negatively-electrified water particles and positively-electrified water particles are alternately sprayed with the intervals, and, in the periods in which no voltage is applied, non-electrified water particles are sprayed. A commercially-available step-up unit equipped with control input can be used as the voltage application unit 15, which supplies the electrification voltages shown in FIGS. 6A to 6F to the electrification spray head 10. Commercially-available step-up units include a unit which outputs DC 0 to 20 kilovolts as an output when DC 0 to 20 volts is applied to the input thereof, and such a commercially-available unit can be used.

Figure 7A:
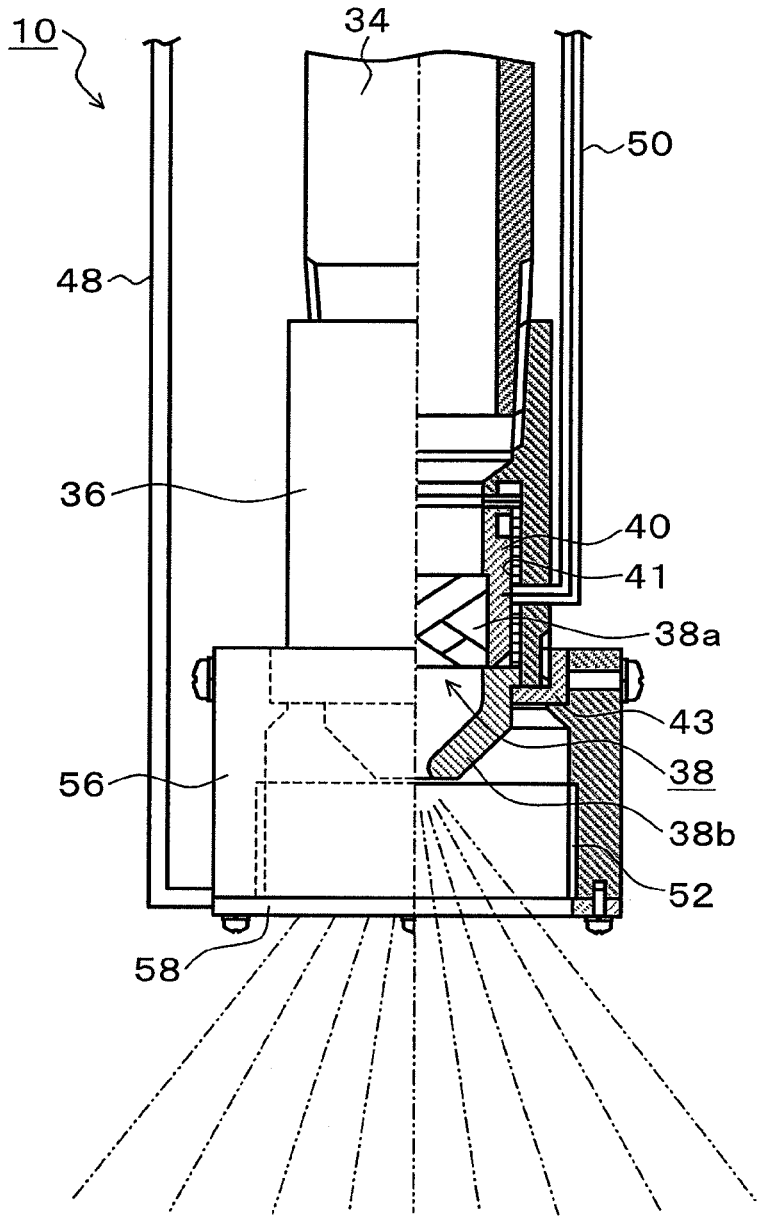
FIGS. 7A and 7B are explanatory drawings showing another embodiment of the electrification spray head using a cylindrical induction electrode unit.
Figure 7B:
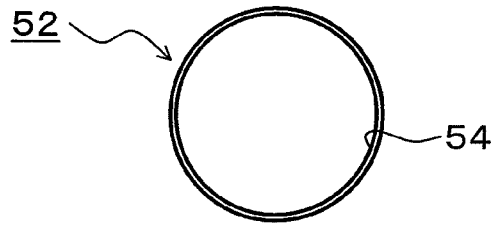

FIGS. 7A and 7B are explanatory drawings showing another embodiment of the electrification spray head using a cylindrical induction electrode unit.

In FIG. 7A, in the electrification spray head 10 of the present embodiment, the head main body 36 is fixed to the distal end of the falling pipe 34 by screw-fixing, the water-side electrode unit 40 is disposed at the inside of the head main body 36 via the insulating member 41, and the earth cable 50 is connected thereto from the upper side. The injection nozzle 38 is disposed below the water-side electrode unit 40, and the injection nozzle 38 is composed of the nozzle main body (rotor) 38*a* and the nozzle head 38*b*. A cylindrical cover 56 is attached to the outside of the lower part of the nozzle head 38*b* via the fixing member 43. A cylindrical induction electrode unit 52 is disposed in the interior of the open part of the lower end of the cover 56 by screw-fixing by a stopper ring 58. A through hole 54 is formed in the cylindrical body of the cylindrical induction electrode unit 52 as shown in the plan view of FIG. 7B focusing thereon. The cable 48 is connected to the cylindrical induction electrode unit 52 through the cover 56 using an insulating material, and an application voltage for electrification is supplied therefrom. Also in the electrification spray head 10 using the cylindrical induction electrode unit 52, when the pressurized water-based fire-extinguishing agent is to be jetted from the injection nozzle 38 to spray water particles, a voltage of, for example, several kilovolts is applied to the cylindrical induction electrode unit 52 while the water-side electrode unit 40 is at 0 volt. As a result, the water particles discharged from the injection nozzle 38 can be electrified in the jetting process in which the water particles pass through the space of the through hole 54 of the cylindrical induction electrode unit 52 wherein an external electric field generated by the application is formed, and the electrified water particles can be sprayed.

Figure 8A:
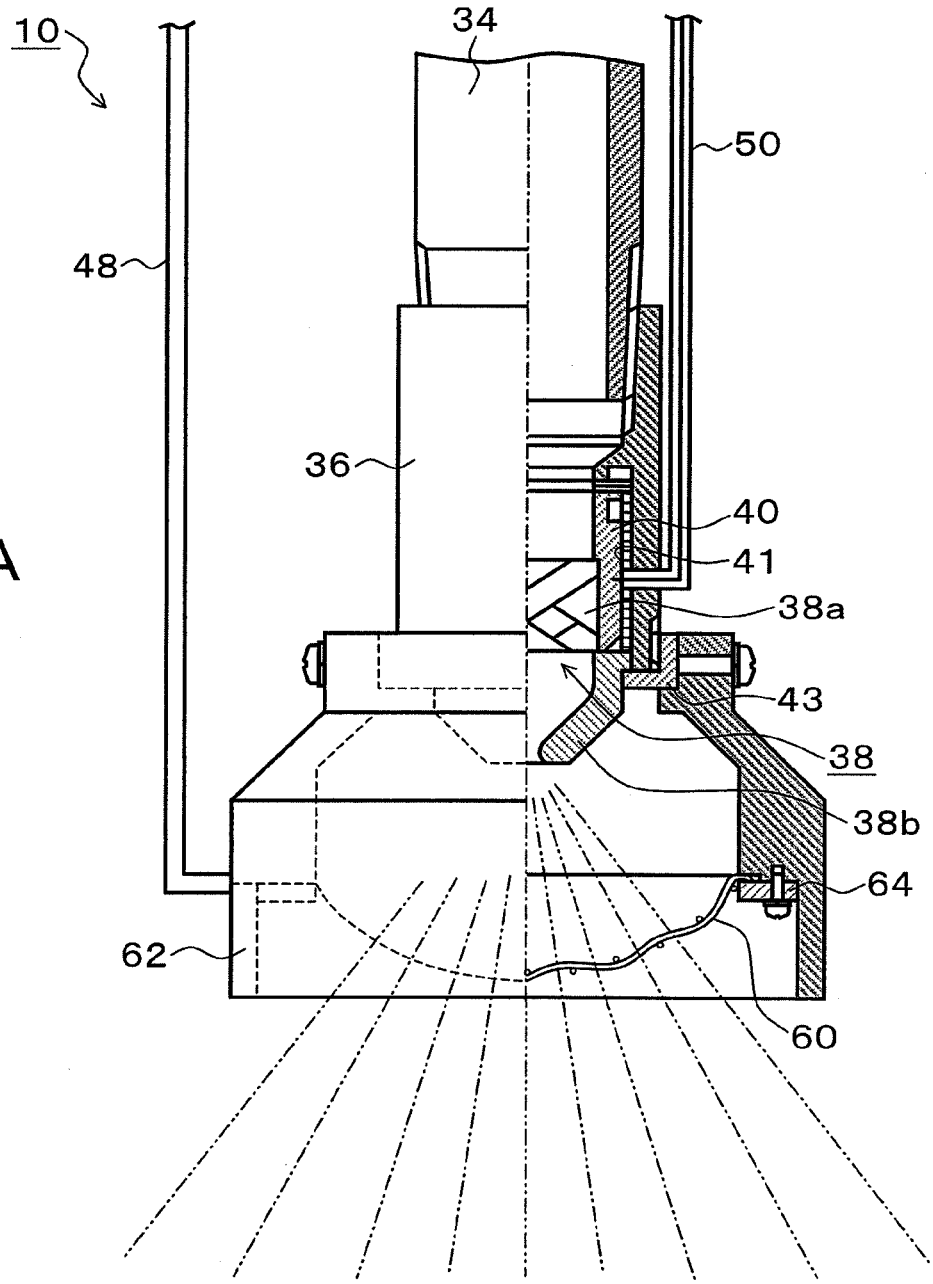
FIGS. 8A and 8B are explanatory drawings showing another embodiment of the electrification spray head using a wire-mesh-like induction electrode unit.
Figure 8B:
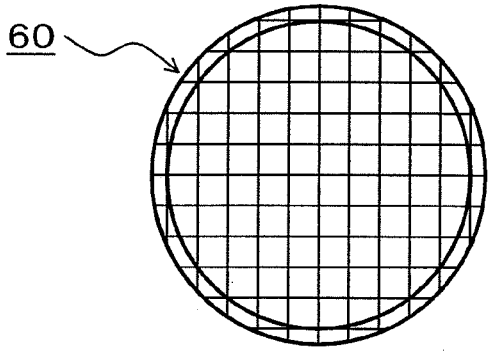

FIGS. 8A and 8B are explanatory drawings showing another embodiment of the electrification spray head using a wire-mesh-like induction electrode unit. In the electrification spray head 10 of FIG. 8A, the head main body 36 is fixed to the lower part of the falling pipe 34 by screw-fixing, the water-side electrode unit 40 is disposed therein via the insulating member 41, and the earth cable 50 is connected thereto. A cover 62 is attached to the lower side of the injection nozzle 38 via the fixing member 43, and the wire-mesh-like induction electrode unit 60 is attached to the open part of the interior of the cover 62. The wire-mesh-like induction electrode unit 60 has the planar shape as focused on by FIG. 8B and uses a wire mesh made of metal having predetermined meshes.

The cover 62 is an insulating material, and the voltage application cable 48 is connected to the wire-mesh-like induction electrode unit 60 through the cover 62 so that a voltage can be applied thereto.

Also in the embodiment of FIGS. 8A and 8B, when the water-based fire-extinguishing agent is jetted from the injection nozzle 38 and converted to water particles, a voltage of, for example, several kilovolts is applied in the form of pulses or alternating current to the wire-mesh-like induction electrode unit 60 side while the water-side electrode unit 40 is at 0 volt. As a result, an external electric field can be generated in the space of jetting from the injection nozzle 38, the jetted particles passing therethrough can be electrified when the particles pass through the open part of the meshes of the wire-mesh-like induction electrode unit 60, and the electrified water particles can be sprayed.

Figure 9A:
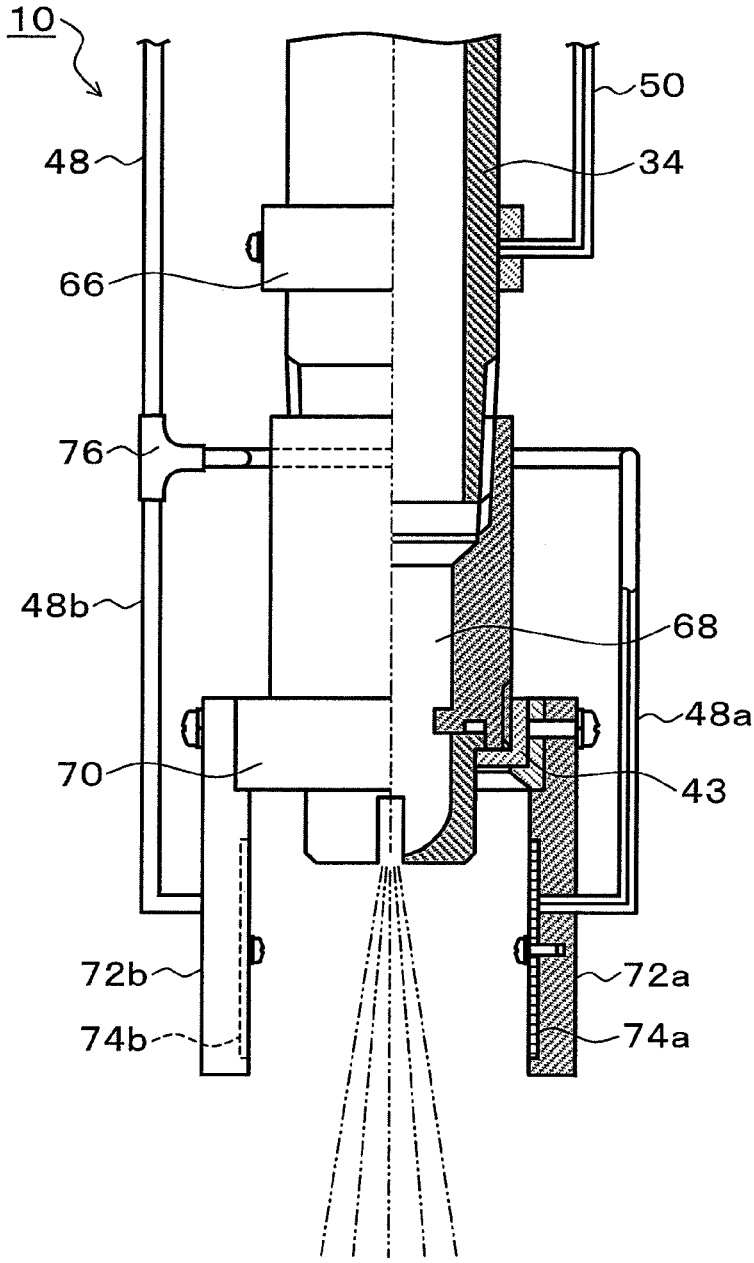
FIGS. 9A and 9B are explanatory drawings showing another embodiment of the electrification spray head using a parallel flat-plate induction electrode unit.
Figure 9B:
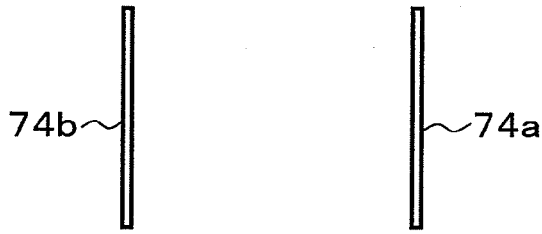

FIGS. 9A and 9B are explanatory drawings showing an embodiment of the electrification spray head using a parallel-plate induction electrode unit.

In the electrification spray head 10 of FIG. 9A, an injection nozzle 68 is fixed at the lower part of the falling pipe 34 by screw-fixing. In this embodiment, the water-side electrode unit uses the falling pipe 34 per se. Therefore, a connection ring 66 is used for the falling pipe 34 to directly connect the earth cable 50. A ring holder 70 is fixed by screw-fixing at a lower part of the injection nozzle 68, and a pair of plate-like holders 72*a* and 72*b* are parallely disposed in the state in which the holders are cantilevered and suspended in the lower side of the ring holder 70. Parallel-plate induction electrode units 74*a* and 74*b* are fixed respectively on the inner opposing surfaces of the holders 72*a* and 72*b*. The parallel-plate induction electrode units 74*a* and 74*b* are parallely disposed in the plan view seen from the lower side thereof as shown in FIG. 9B. The holders 72*a* and 72*b* are insulating materials through which branch cables 48*a* and 48*b* branched from the voltage application cable 48 by a branching unit 76 are connected to the parallel-plate induction electrode units 74*a* and 74*b*, respectively, so as to apply an application voltage of, for example, several kilovolts. Also in the electrification spray head 10 of FIG. 9A, when the water-based fire-extinguishing agent is to be jetted from the injection nozzle 68 and sprayed as jetted particles, a voltage of, for example, several kilovolts is applied between the parallel-plate induction electrode units 74*a* and 74*b* parallely disposed in the distal end side of the falling pipe 34 serving as the water-side electrode unit. As a result, an external electric field can be generated in the space sandwiched by the parallel-plate induction electrode units 74*a* and 74*b*, the jetted water particles can be electrified in the process in which the water particles jetted from the injection nozzle 68 pass through the external electric field, and the electrified water particles can be sprayed.

Figure 10A:
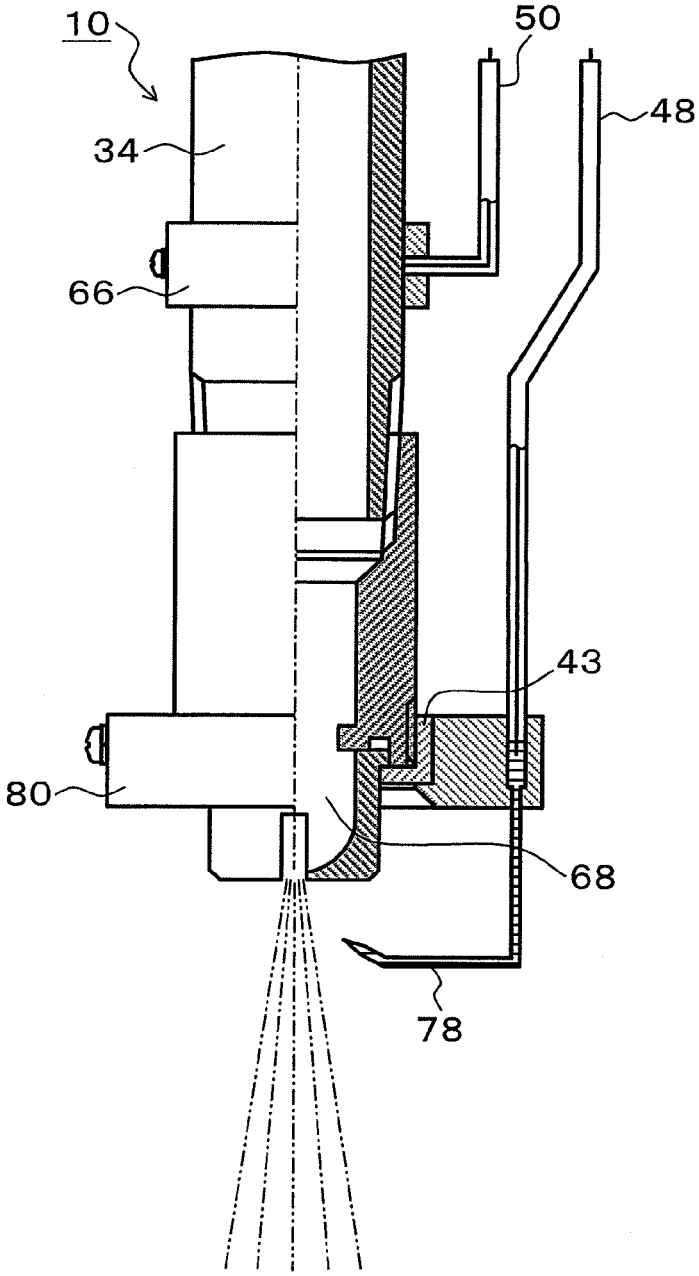
FIGS. 10A and 10B are explanatory drawings showing another embodiment of the electrification spray head using a needle-like induction electrode unit.
Figure 10B:
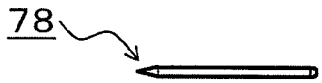

FIGS. 10A and 10B are explanatory drawings showing another embodiment of the electrification spray head using a needle-like induction electrode unit. In the electrification spray head 10 of FIG. 10A, the injection nozzle 68 is screw-fixed at the distal end of the falling pipe 34 used as a water-side electrode unit, the connection ring 66 is attached to the falling pipe 34 so as to electrically connect the earth cable 50. A ring holder 80 is attached to the distal end side of the injection nozzle 68 via the fixing member 43. The needle-like induction electrode unit 78 is attached to a lower part of the ring holder 80. The needle-like induction electrode unit 78 is bent in the shape of a reversed L and has a needle shape in which a distal end is bent obliquely toward the open part of the injection nozzle 68, and the plan view seen from the lower side thereof is as shown in FIG. 10B. The voltage application cable 48 is electrically connected to the needle-like induction electrode unit 78 attached to the ring holder 80. Also in this embodiment, when the water-based fire-extinguishing agent is to be jetted, converted to water particles, and sprayed from the injection nozzle 68, a voltage of, for example, several kilovolts is applied between the falling pipe 34 functioning as a water-side electrode unit and the needle-like induction electrode unit 78 disposed in the distal end side of the nozzle. As a result, an external electric field can be generated in the space between the nozzle open part and the distal end of the needle-like induction electrode unit 78, the jetted particles can be electrified thereat in the jetting process in which the agent is converted to the water particles jetted from the injection nozzle 68, and the agent can be sprayed as the electrified water particles.

The various structures shown in above described embodiments can be applied to the electrification spray head 10 used in the present embodiment; however, the structure is not limited thereto, and an electrification spray head having an arbitrary structure can be used. Regarding the electrification voltage applied to the electrification spray head, whether the induction electrode unit side is to be at positive/negative application voltages, only positive application voltages, or only negative application voltages while the water-side electrode unit is at 0 volt can be also arbitrarily determined in accordance with needs depending on the situation of the burning member side serving as a fire extinguishing target.

Moreover, the present invention includes arbitrary modifications that do not impair the objects and advantages of the present invention, and the present invention is not limited by the numerical values shown in the above described embodiments.

What is claimed is:

1. Fire prevention equipment comprising:

fire-extinguishing agent supplying equipment for pressurizing and supplying a water-based fire-extinguishing agent via a pipe;

an electrification spray head for electrifying jetted particles of the fire-extinguishing agent pressurized and supplied by the fire-extinguishing agent supplying equipment and spraying the particles, the head being installed in a protection section; and a voltage application unit for applying an electrification voltage to the electrification spray head, wherein the electrification spray head is provided with an injection nozzle for converting the water-based fire-extinguishing agent to particles and spraying the particles by jetting only the water-based fire-extinguishing agent to external space, an induction electrode unit disposed in a jetting space side of the injection nozzle, and a water-side electrode unit disposed in the injection nozzle and brought into contact with the water-based fire-extinguishing agent, and wherein the voltage application unit charges the jetted particles by applying an external electric field generated by applying a voltage between the induction electrode unit and the water-side electrode unit of the electrification spray head to the water-based fire-extinguishing agent in a jetting process from the injection nozzle.

2. The fire prevention equipment according to claim 1, wherein the water-side electrode unit of the electrification spray head is part of the injection nozzle using an electrically conductive material or a pipe using an electrically conductive material.

3. The fire prevention equipment according to claim 1, wherein the induction electrode unit of the electrification spray head is any of or a complex of a metal having electric conductivity, a resin having electric conductivity and a rubber having electric conductivity, and has any of a ring shape, a cylindrical shape, a vertical flat-plate shape, a parallel-plate shape, a linear shape and a wire-mesh shape.

4. The fire prevention equipment according to claim 1, wherein in the electrification spray head in which a voltage of the water-side electrode unit is to be zero volts, the water-side electrode unit is led to earth, and a predetermined electrification voltage is applied from the voltage application unit to the induction electrode unit.

5. The fire prevention equipment according to claim 4, wherein the voltage application unit applies the predetermined electrification voltage as a DC, AC, or pulsed electrification voltage to the induction electrode unit.

6. The fire prevention equipment according to claim 4, wherein the voltage application unit applies a voltage of less than ±20 kilovolts as the predetermined electrification voltage to the induction electrode unit.

7. The fire prevention equipment according to claim 1, wherein part or all of the induction electrode is coated with an insulating material.

8. The fire prevention equipment according to claim 1, wherein the water-based fire-extinguishing agent is water, seawater, or water containing a fire-extinguishing power enhancing chemical agent.

9. A spraying method of fire prevention equipment, the method comprising:

in case of fire, pressurizing a water-based fire-extinguishing agent and supplying the fire-extinguishing agent to an electrification spray head via a pipe, the electrification spray head being installed in a protection section; and electrifying and spraying jetted particles of the pressurized and supplied fire-extinguishing agent from the electrification spray head, wherein the electrification spray head is provided with an injection nozzle for converting the water-based fire-extinguishing agent to particles and spraying the particles by jetting only the water-based fire-extinguishing agent to external space, an induction electrode unit disposed in a jetting space side of the injection nozzle, and a water-side electrode unit disposed in the injection nozzle and brought into contact with the water-based fire-extinguishing agent, and wherein in said electrifying of the jetted particles, an external electric field generated by applying a voltage between the induction electrode unit and the water-side electrode unit is applied to the water-based fire-extinguishing agent in a jetting process from the injection nozzle so as to electrify the jetted particles.

10. The spraying method of the fire prevention equipment according to claim 9, wherein the voltage of the water-side electrode unit is caused to be zero volts and lead to earth, and a predetermined electrification voltage is applied to the induction electrode unit.

11. The spraying method of the fire prevention equipment according to claim 10, wherein a DC, AC, or pulsed electrification voltage is applied as the predetermined electrification voltage to the induction electrode unit.

12. The spraying method of the fire prevention equipment according to claim 10, wherein a voltage of less than ±20 kilovolts is applied as the predetermined electrification voltage to the induction electrode unit.

* * * * *